United States Patent [19]

Janusch et al.

[11] Patent Number: 4,514,912

[45] Date of Patent: May 7, 1985

[54] PROCESS FOR DRYING OF ORGANIC SOLID MATERIALS, PARTICULARLY BROWN COALS

[75] Inventors: Alois Janusch, Leoben-Seegraben; Franz Mayer, Graz, both of Austria

[73] Assignee: Voest-Alpine Aktiengesellschaft, Vienna, Austria

[21] Appl. No.: 206,896

[22] Filed: Nov. 14, 1980

[30] Foreign Application Priority Data

Jan. 21, 1980 [AT] Austria ..... 312/80

[51] Int. Cl.[3] ..... F26B 3/06

[52] U.S. Cl. ..... 34/37; 34/15; 34/9; 44/1 G; 44/10 D; 44/10 E; 44/12

[58] Field of Search ..... 44/1 G, 10 D–10 F, 44/11, 12; 34/36, 37, 8, 9, 12, 14, 15

[56] References Cited

U.S. PATENT DOCUMENTS

| | | | |
|---|---|---|---|
| 1,679,078 | 7/1928 | Fleissner | 34/15 |
| 3,007,254 | 11/1961 | Schuster | 34/37 |
| 3,027,652 | 4/1962 | Wallace | 34/32 |
| 3,518,773 | 7/1970 | Johanson | 34/36 |
| 4,285,140 | 8/1981 | van Raam et al. | 34/12 |

*Primary Examiner*—William R. Dixon, Jr.
*Assistant Examiner*—Margaret B. Medley
*Attorney, Agent, or Firm*—Cushman, Darby & Cushman

[57] ABSTRACT

For drying organic solid materials, such as brown coals, the solid materials are, particularly for the purpose of immediately subsequent briquetting or refinement or gasification, respectively, preheated and introduced into an atmosphere of saturated steam at super-atmospheric pressure and increased temperature. After such a first drying stage (1, 2) operated with saturated steam, the process water formed in this drying stage is separated and the solid materials are at least partially pressure-released and subsequently further dried within an atmosphere of superheated steam at a temperature of at least 200° C. of this steam atmosphere. The steam of this further drying stage (7) is passed along a closed circuit via heat exchangers (10, 11) and brought to or maintained at the required temperature. A portion of the steam passed along a closed circuit, that portion approximately corresponding to the amount of steam having its origin in the water content of the solid materials, is tapped via conduit (12) and used for preheating purposes (FIG. 1).

15 Claims, 3 Drawing Figures

PROCESS FOR DRYING OF ORGANIC SOLID MATERIALS, PARTICULARLY BROWN COALS

The present invention refers to a process for drying of organic solid materials, particularly brown coals, by using steam. In connection with drying of brown coals it is known that the frequently considerable content of the brown coal in humidity has for a major part its origin in water absorbed within the capilaries but also in chemically bound water which, when immediately heating the coal, can only be removed under a high energy consumption. It is also known that this water can be expelled from the coal by steam or also by hot water. There are also known processes which allow to semi-continuously dry coal. Such known processes have, however, frequently made a better use of the energy supplied than the original Fleissner-process, but such known processes have only solved in an unsatisfying manner the problem of water removal. With all these known processes the solid material is further dried or finally dried, respectively, after having been dried under the influence of saturated steam or hot water. The dried solid materials, still have a content in water which, however, is low.

The present invention now particularly refers to a process for drying organic solid materials, particularly brown coals, in which the preheated solid materials are passed through at least one drying stage and put there under the action of saturated steam under a super-atmospheric pressure. It is an object of the present invention to improve the drying effect and the economy of such a process, and the invention essentially consists in that the solid materials are, after removal of the process water formed, at least partially, pressure-released and further dried in an atmosphere of super-heated steam at a temperature of the steam atmosphere of at least 200° C. and in that the steam from the steam atmosphere is passed along a closed circuit over heat exchangers and brought to and/or maintained at the temperature of the steam atmosphere, the excess steam of the steam obtained and to be supplied to the heat exchanger or exchangers being tapped from the steam obtained and being used for preheating purposes. In view of further drying or final drying, respectively, being effected in an atmosphere of super-heated steam and not in air, further water is removed from the solid materials, the final water content of the solid materials thus becoming further reduced. In view of the process water already being removed at an earlier stage, handling of a water ballast is avoided which would have to be also heated. In view of the super-heated steam being passed in a closed circuit and being heated on its path along this closed circuit, the atmosphere of hot steam is maintained on the preselected temperature. In view of the solid materials being further dried within the atmosphere of super-heated steam, thereby removing from the solid materials further water evaporating into said steam atmosphere, the amount of steam is increased and the resulting portion of the steam must be tapped off. By using the tapped steam for preheating purposes, the economy of the process is increased.

According to the invention, the steam passed through a closed circuit can be heated by waste water coming from the drying stage operated with saturated steam. According to a preferred embodiment of the process according to the invention, the temperature of the waste water used for heating the steam passed through a closed cycle is increased within an oxidation reactor within which the solid materials contained in the waste water are wet-oxidized by supplying air. This measure does not only increase the economy of the process but results also in a purification of the waste water in view of the particulate solid material or coal, respectively, contained within the waste water being subjected to a combustion in the presence of water, so that finally the waste water can be discharged from the process in a substantially purified condition.

The steam passed along a closed circuit can, according to the invention, also be heated by external heat, for example by the flue gases of a boiler plant used for producing the steam required for the drying stage operated with saturated steam pressure. This measure can be used also together with heating the steam by the heat content of the waste water. Utilization of the heat content of the flue gases will be necessary if the super-heated steam is to be heated to particularly high temperatures, i.e. if high temperatures of the gas atmosphere are required. According to the invention, the process can be performed such that the atmosphere of super-heated steam is maintained under a pressure of 1 to 10 bar, preferably 5 to 10 bar, and has a temperature of 200° to 550° C. In this case, the solid materials can be heated within the atmosphere of super-heated steam to a temperature of 150° to 450° C. Within the space containing the steam atmosphere, the super-heated steam can be passed through the space containing the steam atmosphere in co-current or in countercurrent to the solid materials continuously charged into and continuously discharged from this space. In both cases, heat contained in the steam is transferred to the solid materials and the amount of heat transferred must be replaced within the heat exchangers. The process according to the invention is conveniently performed such that the steam passed along a closed circuit is tapped with a temperature of approximately 150° C. and heated to a temperature of approximately 550° C. The tapped, excessive amount of steam can be used for various preheating purposes within the drying process. For example and according to the invention, this amount of steam can be used for preheating the combustion air and/or the boiler feed water for the boiler plant used for producing the steam for the drying stage operated with saturated steam but can also be used for preheating the solid materials to be supplied to the drying stage operated with saturated steam.

According to the invention, fine-grained solid materials with a particle size of 1 μm to 5 mm can be subjected to a drying operation within the atmosphere of super-heated steam, whereupon the solid materials are discharged from said atmosphere and optionally pressure-released and are subjected to further processing, for example to hot-briquetting or gasification. If the fine-grained solid materials are subsequently subjected to hot-briquetting, a relatively high heating temperature within the atmosphere of super-heated steam is required. In this case and according to the invention, said atmosphere has a temperature of approximately 550° C. According to the invention, the solid materials can be subjected to the drying operation within the atmosphere of super-heated steam also in lumpy form, preferably in form of lumps having a lump size of 5 to 50 mm, whereupon the lumpy solid materials are discharged from this atmosphere and optionally pressure-released and subsequently cooled. In this case, the atmosphere of super-heated steam can have a temperature of approximately 200° C., thus obtaining economic advantages in view of the lower amount of heat to be supplied and also reducing the danger of self-ignition of the dried solid materials. In this case, cooling is conveniently effected in an atmosphere of low oxygen content, for example in an inert gas atmosphere. In all cases, it is convenient to pass the steam circulated along a closed circuit in countercurrent to the solid material within the atmosphere of super-heated steam so that the steam circulated along a closed circuit and tapped from the steam atmosphere has already a relatively low temperature and can be, for example, already saturated steam.

The invention is further described with reference to the drawing schematically illustrating by a flow chart the process according to the invention as applied for drying brown coals.

Figure 1:
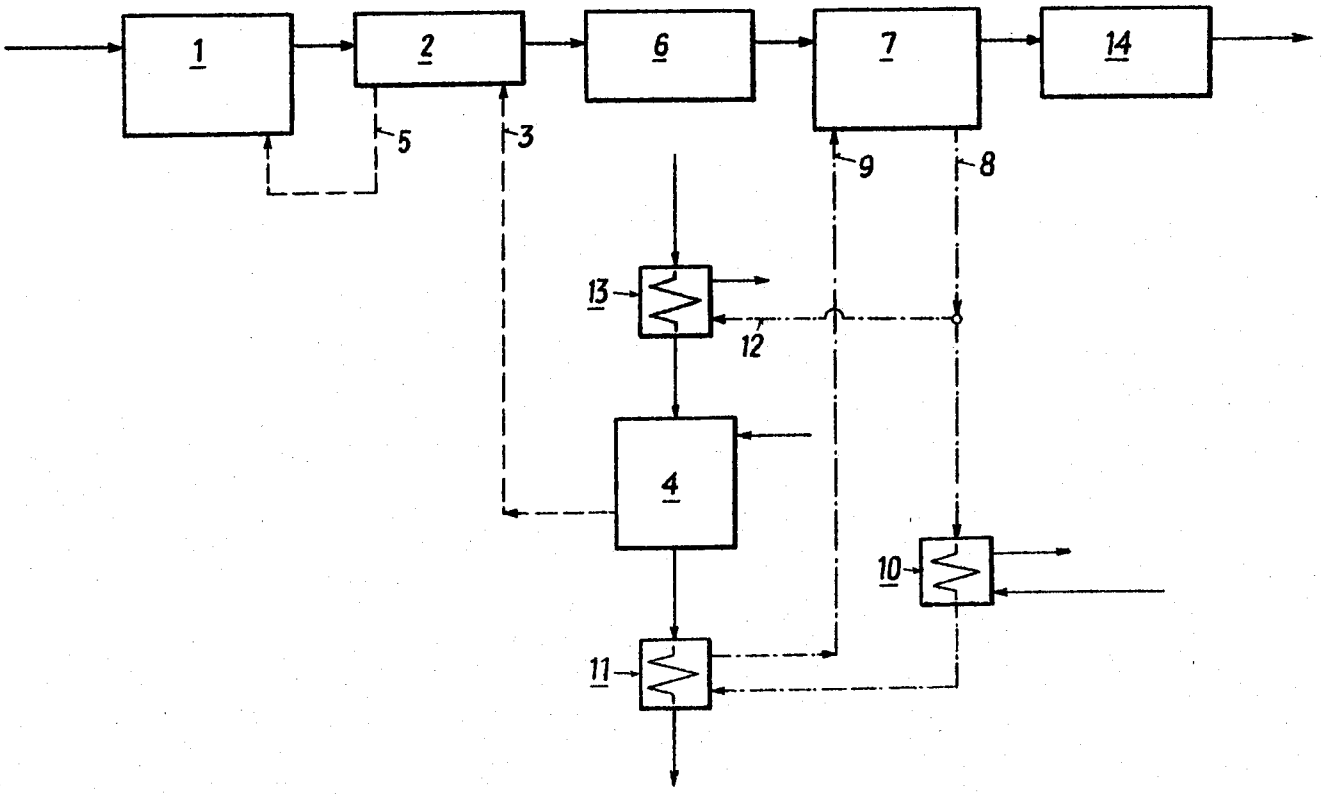
FIG. 1 shows a flow chart in principle.

According to the flow chart of FIG. 1, the preheated brown coal enters an autoclave 1, in which the coal is dried under the action of saturated steam. The process temperature within the autoclave is approximately 250° C. and the pressure is approximately 40 bar. The brown coal leaving the autoclave 1 is entering a centrifuge 2 which is operated under essentially the same pressure and the same temperature as the autoclave 1. Saturated steam coming from a boiler plant 4 is fed to the centrifuge 2 via a conduit 3. Saturated steam leaving the centrifuge 2 enters the autoclave 1 via a conduit 5. After removal of the waste water expelled from the brown coal, the brown coal discharged from the centrifuge 2 is entering a pressure-release stage 6 where the coal is pressure-released to a pressure of 1 bar, whereby the temperature is lowered to 100° C. It is, however sufficient to release the pressure to approximately 4 to 10 bar, thereby obtaining a correspondingly high equilibrium temperature. Behind the pressure-release stage 6, the brown coal is entering a drying stage 7 operated with hot steam, in which stage the coal is subjected to the action of an atmosphere of super-heated steam. Within this drying stage 7, the brown coal shall be heated by the super-heated steam to a temperature within the range of 150° to 350° C. depending on whether the brown coal shall be discharged in a lumpy form or whether the brown coal shall subsequently be hot-briquetted. With lumpy brown coal a heating temperature of 150° C. is sufficient, whereas with fine-grained brown coal of, for example, a particle size of 1 μm to 5 mm the temperature is conveniently approximately 350° C. In this drying stage 7 operated with super-heated steam, a pressure of 1 bar can be maintained, however the pressure maintained in this drying stage 7 is preferably within the range of 5 to 10 bar, pressure-relief within the pressure-release stage 6 then being only effected to a value within the mentioned range. The temperature of the atmosphere within the hot steam drying stage 7 is, in dependence on the desired heating temperature of the brown coal, approximately 200° to 550° C. This temperature is attained or maintained by super-heated steam supplied via a conduit 8 and 9 and passed along a closed circuit through heat exchangers 10 and 11. Hot water is expelled from the brown coal within the hot steam drying stage 7, so that the amount of steam becomes increased. Excess steam is tapped at a position before the heat exchangers 10, 11 via a conduit 12 and used within a heat exchanger 13 for preheating the combustion air for the boiler plant 4. Within the heat exchanger 10, the super-heated steam is heated by hot water coming from the drying stage 1 operated with saturated steam, whereas within the heat exchanger 11 the super-heated steam is heated by flue gases of the boiler plant 4. The fine-grained brown coal coming from the hot steam drying stage 7 is entering a hot-briquetting plant 14. In place of the hot-briquetting plant also a gasifying plant can be provided. Brown coal of lumpy form coming from the hot steam drying stage is entering a cooling stage not shown and is after this cooling stage banked out.

Figure 2:
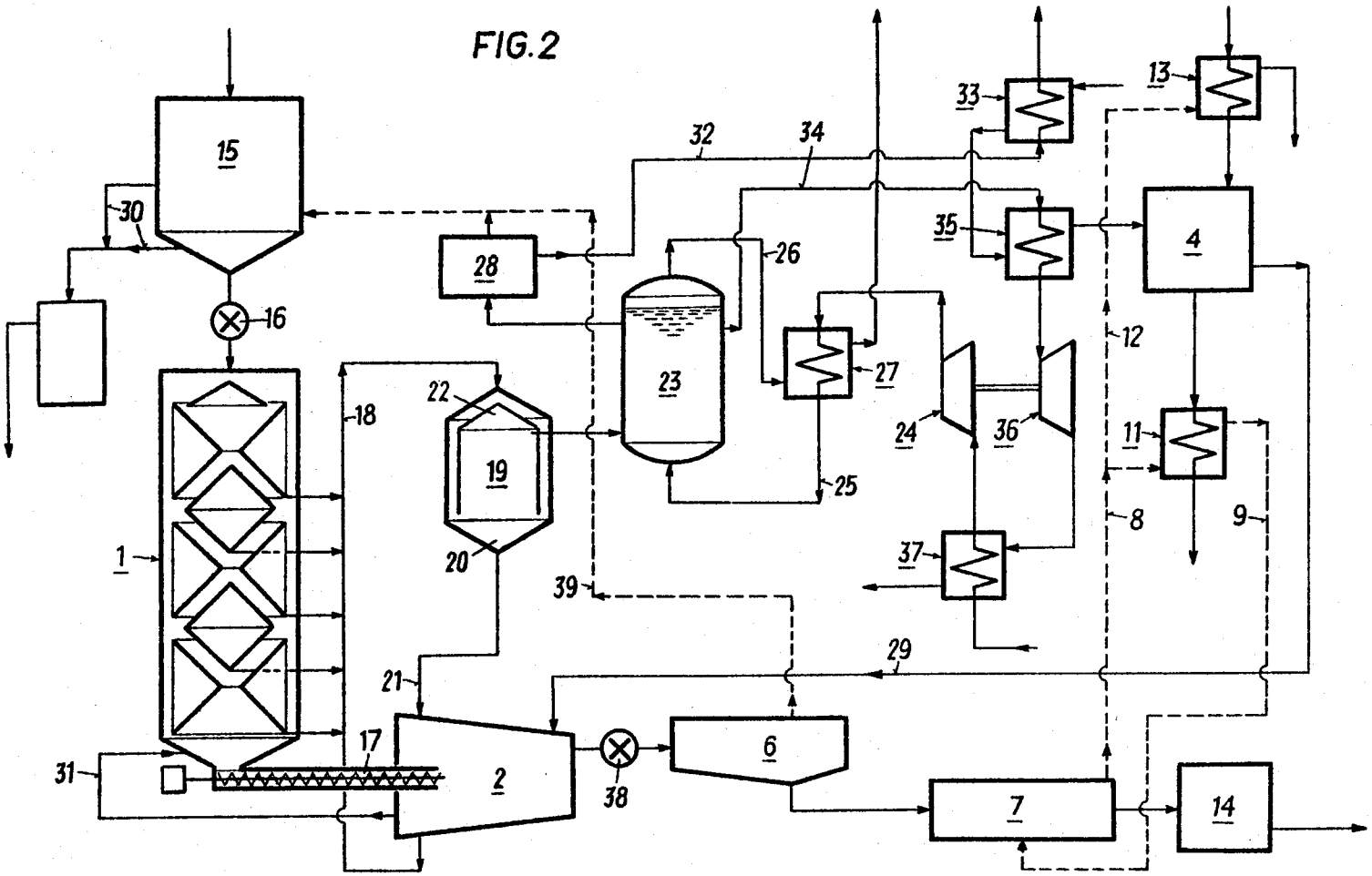
FIGS. 2 and 3 show two different embodiments in detailed flow charts.

In the arrangement shown in FIG. 2, the brown coal is preheated in a preheating bunker 15 at atmospheric pressure and is fed, via a pressure lock 16, into the autoclave 1 where the coal is moving along cascades of sieves. The water obtained within the preheating bunker 15 is discharged as waste water via a conduit 30. The brown coal coming from the autoclave 1 is charged into the centrifuge 2 by means of a conveyor screw 17. Into the centrifuge 2, saturated steam coming from a boiler plant 4 is supplied via a conduit 29 and saturated steam leaving the centrifuge 2 is supplied into the autoclave 1 via a conduit 31. The effluent water coming from the various stages of the sieve cascade is, together with the effluent water coming from the centrifuge 2, fed via a conduit 18 into a separator 19, in the lower portion 20 of which water enriched in particulate brown coal is present. This water is recycled to the centrifuge via a conduit 21. Comparatively pure water containing dissolved substances and coal particles is coming from the upper portion 22 of the separator 19 into an oxidizing reactor 23. Within this oxidizing reactor 23 a wet combustion is effected, thereby increasing the temperature of the water. For effecting this wet combustion, air is blown into the oxidation reactor by means of a compressor 24 via a conduit 25. Gases and vapour produced within the oxidizing reactor 23 are vented via a conduit 26 and used for heating the combustion air within a heat exchanger 27. Part of the water heated within the oxidizing reactor is supplied to a pressure-release means 28 and the steam produced therein is used for preheating the brown coal within the bunker 15, while part of the liquid phase of the pressure-release means is disposed of via a conduit 32, but used for preheating the boiler feed water for the boiler 30 within a heat exchanger 33. A further portion of the liquid phase present within the oxidizing reactor 23 is removed from this oxidizing reactor via a conduit 34 for further preheating the boiler feed water in a heat exchanger 35 and is then expanded within a turbine 36 driving the compressor 24. The remaining sensible heat content of this portion of the liquid phase is used within a heat exchanger 37 for preheating the combustion air supplied to the oxidizing reactor 23.

Brown coal coming from the centrifuge 2 is entering the pressure-release means 6 via a pressure lock 38 and subsequently entering the hot steam drying stage 7. The brown coal leaving the hot steam drying stage 7 is entering the hot-briquetting plant 14. Steam coming from the pressure-release means 6 is tapped by means of a conduit 39 for preheating the brown coal within the preheating bunker 15.

Super-heated steam coming from the hot steam drying stage 7 is passed via conduit 8 and 9 along a closed circuit via a heat exchanger being heated by the flue gases of the boiler plant 4. Excessive super-heated steam is removed via the conduit 12 and used within a heat exchanger 13 for heating the combustion air for the boiler plant 4. Because the brown coal shall subsequently be briquetted, fine-grained brown coal having a grain size of 1 μm to 5 mm is subjected to the process described.

Figure 3:
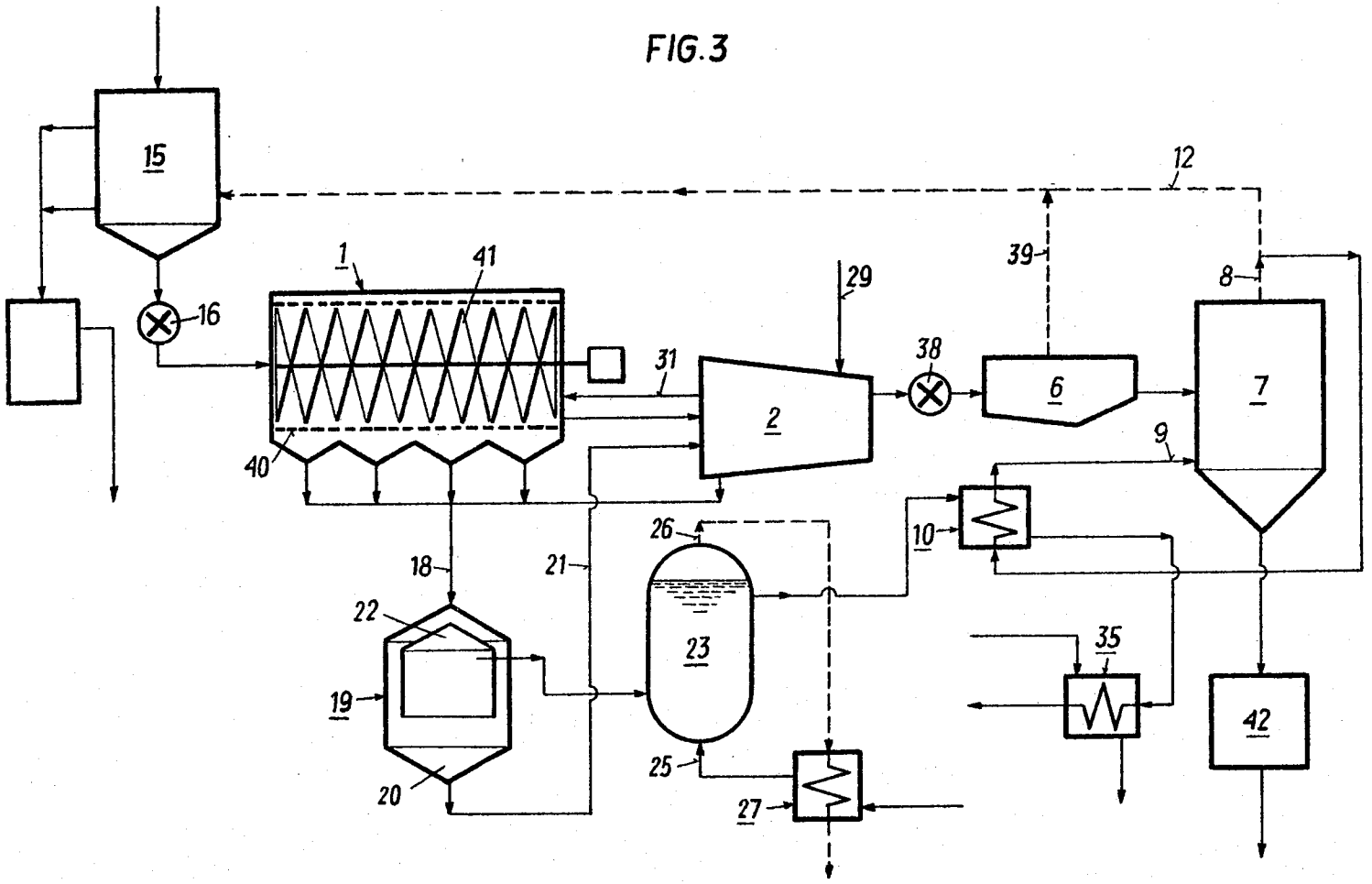

In the flow chart according to FIG. 3, a sieve drum 40 is arranged within the autoclave 1 and brown coal coming from the preheating bunker 15 and having been introduced into the autoclave 1 is transported through this sieve drum 40 by means of a conveyor screw 41. The brown coal coming from the autoclave 1 is entering the centrifuge 2. Saturated steam is supplied to the centriuge via the conduit 29 and then passed into the autoclave 1 via the conduit 31. The water obtained within the autoclave 1 is, together with the water obtained in the centrifuge 2, fed into the separator 19 via a conduit 18, water enriched in coal particles being recycled into the centrifuge from the lower portion 20 of this separator 19 while comparatively pure water is passed from the upper portion 22 of the separator into the oxidizing reactor 23.

The gases, i.e. $N_2$, $CO_2$ and steam, produced within the oxidizing reactor, are again removed via the conduit 26 and are heating within the heat exchanger 27 the combustion air, optionally enriched in oxygen, supplied via the conduit 25 into the oxidizing reactor.

Brown coal discharged from the centrifuge 2 is again, via the pressure lock 38, entering the pressure-release means 6 and behind thereof the hot steam drying stage 7 within which the brown coal is dried within an atmosphere of super-heated steam. The brown coal discharged from this hot steam drying stage 7 and being present in lumpy form enters with this embodiment of the process a cooler 42 and is banked out behind this cooler.

Super-heated steam is again passed along a closed circuit through the conduit 8 and 9 and through the heat exchanger 10 in which the liquid phase of the oxidizing reactor 23 is used as the heating fluid. In this case it is sufficient to effect heating by the process water or the liquid phase of the oxidizing reactor 23, respectively, because the lumpy coal need only be heated to lower temperatures than the temperatures to which fine-grained brown coal, which shall subsequently be briquetted, must be heated. The excessive portion of the super-heated steam passed along a closed circuit is tapped by means of a conduit 12 and is, in this case, used together with the steam coming from the pressure-release means 6 via the conduit 31 for preheating the brown coal within the bunker 15. The water leaving the heat exchanger 10 and being formed of the liquid phase within the oxidizing reactor 23 is, with this embodiment, used for preheating the boiler feed water within the heat exchanger 35.

What is claimed is:

1. Process for drying organic solid materials, particularly brown coals, in which the preheated solid materials are passed through at least one drying stage and put there under the action of saturated steam under a super-atmospheric pressure, characterized in that the solid materials are, after removal of the process water formed, at least partially pressure-released and further dried in an atmosphere of super-heated steam at a temperature of the steam atmosphere of at least 200° C. and in that the steam from the steam atmosphere is passed along a closed circuit over heat exchangers and brought to and/or maintained at the temperature of the steam atmosphere, the excess steam of the steam obtained and to be supplied to the heat exchanger or exchangers being tapped from the steam obtained and being used for preheating purposes.

2. Process as claimed in claim 1, characterized in that the steam passed along a closed circuit is heated by waste water coming from the drying stage operated with saturated steam.

3. Process as claimed in claim 2, characterized in that the temperature of the waste water used for heating the steam passed along a closed circuit is increased within an oxidizing reactor in which particles of the solid materials contained in the waste water are wet oxidized by air supplied.

4. Process as in claim 1 characterized in that the steam passed along a closed circuit is heated by external heat, for example by the flue gases of a boiler plant used for generating the steam required for the drying stage operated with saturated steam.

5. Process as in claim 1 characterized in that the atmosphere of super-heated steam is maintained under a pressure of 1 to 10 bar, preferably 5 to 10 bar, and has a temperature of 200° to 550° C.

6. Process as in claim 1 characterized in that the solid materials are heated within the atmosphere of super-heated steam to a temperature of 150° to 450° C.

7. Process as in claim 1 characterized in that the steam passed along a closed circuit is removed with a temperature of approximately 150° C. and is heated to a temperature of approximately 550° C.

8. Process as in claim 1 characterized in that the tapped excessive portion of the steam is used for preheating the combustion air and/or the boiler feed water for the boiler plant used for generating the steam required for the drying stage operated with saturated steam.

9. Process as in claim 1 characterized in that the tapped excessive portion of the steam is used for preheating the solid materials to be supplied to the drying stage operated with saturated steam.

10. Process as in claim 1 characterized in that the solid materials are subjected to the drying operation within the atmosphere of superheated steam in form of fine grain having a grain size of 1 μm to 5 mm and are then removed from this atmosphere and optionally pressure-released, whereupon the solid materials are subjected to a further processing, for example to hot-briquetting or gasification.

11. Process as claimed in claim 10, characterized in that in case of subsequent hot-briquetting the atmosphere of superheated steam has a temperature of approximately 550° C.

12. Process as in claim 1 characterized in that the solid materials are subjected to drying in the atmosphere of superheated steam in lumpy shape, preferably in lumps having a lump size of 5 to 50 mm, and are after removal from this atmosphere and after an optional pressure-release operation subjected to cooling.

13. Process as claimed in claim 12, characterized in that the atmosphere of superheated steam has a temperature of approximately 200° C.

14. Process as claimed in claim 12 or 13, characterized in that cooling is effected in a gas atmosphere of reduced oxygen content, for example in an inert gas atmosphere.

15. Process as in claim 1 characterized in that the steam passed along a closed circuit is passed in countercurrent to the solid materials in the atmosphere of superheated steam.

* * * * *